US011322083B2

(12) United States Patent
Nie et al.

(10) Patent No.: US 11,322,083 B2
(45) Date of Patent: May 3, 2022

(54) OLED DISPLAY PANEL AND DRIVING METHOD THEREOF

(71) Applicant: Shenzhen China Star Optoelectronics Semiconductor Display Technology Co., Ltd., Shenzhen (CN)

(72) Inventors: Chenglei Nie, Shenzhen (CN); Baixiang Han, Shenzhen (CN); Kun Cao, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 263 days.

(21) Appl. No.: 16/499,286

(22) PCT Filed: May 23, 2019

(86) PCT No.: PCT/CN2019/088211
§ 371 (c)(1),
(2) Date: Sep. 29, 2019

(87) PCT Pub. No.: WO2020/211152
PCT Pub. Date: Oct. 22, 2020

(65) Prior Publication Data

US 2021/0335236 A1 Oct. 28, 2021

(30) Foreign Application Priority Data

Apr. 19, 2018 (CN) ..... 201910319984.2

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2320/0233* (2013.01)

(58) Field of Classification Search
CPC .. G09G 3/3233; G09G 3/3266; G09G 3/3275; G09G 2320/0233
See application file for complete search history.

(56) References Cited

U.S. PATENT DOCUMENTS

2009/0309516 A1 12/2009 Kim
2011/0205206 A1* 8/2011 Yoo ..... G09G 3/3275 345/211

FOREIGN PATENT DOCUMENTS

CN 101471032 A 7/2009
CN 102629447 A 8/2012

* cited by examiner

*Primary Examiner* — Stacy Khoo
(74) *Attorney, Agent, or Firm* — Nathan & Associates; Nathan Menachem

(57) ABSTRACT

An organic light emitting diode (OLED) display panel and a driving method thereof are provided. The OLED display panel includes a plurality of pixel unit circuits and an external compensation unit connected to all of the pixel unit circuits. The external compensation unit performs external compensation on each of the pixel unit circuits, obtains an initial threshold voltage of a corresponding driving thin film transistor (TFT) of each of the pixel unit circuits, adds the initial threshold voltage to a predetermined initial potential, and then inputs a sum of the initial threshold voltage and the predetermined initial potential to each of the pixel unit circuits Each of the pixel unit circuits performs internal compensation based on the sum of the initial threshold voltage and the predetermined initial potential.

8 Claims, 7 Drawing Sheets

OLED DISPLAY PANEL AND DRIVING METHOD THEREOF

CROSS REFERENCE TO RELATED APPLICATIONS

This application claims the priority of International Application No. PCT/CN2019/088211, filed on May 23, 2019, which claims priority to Chinese Application No. 201910319984.2, filed on Apr. 19, 2019. The entire disclosures of the above applications are incorporated herein by reference.

FIELD OF INVENTION

The present disclosure relates to a technical field of displays, and more particularly to an organic light emitting diode (OLED) display panel and a driving method thereof.

BACKGROUND OF INVENTION

Organic light emitting diode (OLED) display devices have advantages of being self-luminous, having low driving voltages, high luminous efficiency, short response time, high sharpness and contrast, nearly 180° viewing angles, and wide operating temperature ranges, and allowing implementation of flexible displays and large area full color displays, etc., and have been commonly recognized by industry as display devices with the most development potential.

OLED devices generally include: substrates, anodes formed on substrates, hole injection layers formed on anodes, hole transporting layers formed on hole injection layers, luminescent material layers formed on hole transporting layers, electron transporting layers formed on luminescent material layers, electron injection layers formed on electron transporting layers, and cathodes formed on electron injection layers. A light emission principle of OLED devices is that semiconductor materials and organic luminescent materials are driven by electric fields, causing luminescence by carrier injection and recombination. Specifically, OLED devices usually use indium tin oxide (ITO) electrodes and metal electrodes to correspondingly serve as anodes and cathodes of OLED devices. Driven by a certain voltage, electrons and holes are correspondingly injected into electron transporting layers and hole transporting layers correspondingly from cathodes and anodes. Electrons and holes migrate to luminescent material layers correspondingly through electron transporting layers and hole transporting layers, and meet in luminescent material layers, to form excitons and excite luminescent molecules. Excited luminescent molecules emit visible light through radiation relaxation.

In an existing OLED pixel circuit, there are two thin film transistors (TFT) and a capacitor, which is abbreviated as a 2T1C pixel circuit. A first TFT is referred to as a switching TFT. The first TFT is configured to control entry of a data signal. A second TFT is referred to as a driving TFT. The second TFT is configured to control a current passing through an OLED. Therefore, the importance of a threshold voltage of the driving TFT is obvious. A positive or negative drift of the threshold voltage cause different currents to flow through the OLED under the same data signal, resulting in a problem of display non-uniformity.

Currently, the TFT fabricated using low temperature polysilicon (LTPS) or oxide may exhibit a drift of the threshold voltage during a using process. For example, factors such as irradiation of oxide semiconductor and voltage stress effects of source and drain electrodes may cause the drift of the threshold voltage. As a result, a current flowing through the OLED is inconsistent with a required current and display uniformity of a panel is not satisfied. The drift of the threshold voltage in the typical 2T1C circuit cannot be improved by regulation. Therefore, a different method needs to be used to reduce or even eliminate effects of the drift of threshold voltage. An approach of implementing threshold voltage compensation for the driving TFT simply by adding new TFTs and signal lines inside a pixel is called internal compensation. Advantages of this approach are that a compensation process is relatively simple and operation speed is faster. Disadvantages of this approach are that the pixel circuit is complex, and a compensation range is limited. An approach of performing threshold voltage compensation by an external driving chip of the panel is called external compensation. Advantages of this approach are that the pixel circuit is relatively simple, and a compensation range is relatively large. Disadvantages of this approach are that a compensation process is complex, and operation speed is slow.

SUMMARY OF INVENTION

An object of the present disclosure is to provide an organic light emitting diode (OLED) display panel that can compensate for a non-uniformity of a corresponding initial threshold voltage of each driving thin film transistor (TFT) caused by a process, and a permanent drift of a corresponding actual threshold voltage of each driving TFT due to external stress, and can instantly compensate for a relatively smaller drift of the actual threshold voltage occurred when the OLED display panel is lightened.

An object of the present disclosure is to provide an OLED display panel driving method that can compensate for a non-uniformity of a corresponding initial threshold voltage of each driving TFT caused by a process, and a permanent drift of a corresponding actual threshold voltage of each driving TFT due to external stress, and can instantly compensate for a relatively smaller drift of the actual threshold voltage occurred when the OLED display panel is lightened.

In order to realize the aforementioned object, the present disclosure provides an OLED display panel including: a plurality of pixel unit circuits and an external compensation unit connected to all of the pixel unit circuits.

The external compensation unit is configured to perform external compensation on each of the pixel unit circuits, obtain an initial threshold voltage of a corresponding driving TFT of each of the pixel unit circuits, add the initial threshold voltage to a predetermined initial potential, and then input a sum of the initial threshold voltage and the predetermined initial potential to each of the pixel unit circuits.

Each of the pixel unit circuits is configured to perform internal compensation based on the sum of the initial threshold voltage and the predetermined initial potential, to compensate for a drift of an actual threshold voltage of the corresponding driving TFT.

Each of the pixel unit circuits includes: a corresponding first TFT, a corresponding second TFT, a corresponding third TFT, a corresponding fourth TFT, a corresponding fifth TFT, a corresponding sixth TFT, a corresponding capacitor, and a corresponding light emitting diode (LED).

The first TFT has a gate electrically connected to a first node, a source electrically connected to a second node, and a drain electrically connected to a third node, and the first TFT is the driving TFT.

The second TFT has a gate receiving an (n)th scan signal corresponding to a corresponding row that each of the pixel unit circuits is located, a source electrically connected to the second node, and a drain receiving a data signal.

The third TFT has a gate receiving the (n)th scan signal corresponding to the corresponding row that each of the pixel unit circuits is located, a source electrically connected to the first node, and a drain electrically connected to the third node.

N is an integer greater than one, the fourth TFT has a gate receiving an (n−1)th scan signal corresponding to a previous row of the corresponding row that each of the pixel unit circuits is located, a source receiving the sum of the initial threshold voltage and the predetermined initial potential, and a drain electrically connected to the first node.

The fifth TFT has a gate receiving a control signal, a source receiving a positive supply voltage, and a drain electrically connected to the second node.

The sixth TFT has a gate receiving the control signal, a source electrically connected to the third node, and the drain electrically connected to an anode of the LED.

A cathode of the LED receives a negative supply voltage.

The capacitor has one end electrically connected to the first node, and the other end electrically connected to the positive supply voltage.

The first TFT, the second TFT, the third TFT, the fourth TFT, the fifth TFT, and the sixth TFT are all P-type TFTs.

The control signal, the (n−1)th scan signal, and the (n)th scan signal are combined such that a plurality of corresponding combined portions correspond to a reset phase, a phase for data to be input and to program, and a display light emitting phase sequentially.

During the reset phase, the control signal is at a high potential, the (n−1)th scan signal is at a low potential, and the (n)th scan signal is at the high potential.

During the phase for data to be input and to program, the control signal is at the high potential, the (n−1)th scan signal is the high potential, and the (n)th scan signal is at the low potential.

During the display light emitting phase, the control signal is at the low potential, the (n−1)th scan signal is at the high potential, and the (n)th scan signal is at the high potential.

The present disclosure also provides an OLED display panel driving method including:

a step S1 of providing an OLED display panel, wherein the OLED display panel includes: a plurality of pixel unit circuits and an external compensation unit connected to all of the pixel unit circuits;

a step S2 of performing external compensation on each of the pixel unit circuits, obtaining an initial threshold voltage of a corresponding driving TFT of each of the pixel unit circuits, adding the initial threshold voltage to a predetermined initial potential, and then inputting a sum of the initial threshold voltage and the predetermined initial potential to each of the pixel unit circuits by the external compensation unit; and a step S3 of performing internal compensation based on the sum of the initial threshold voltage and the predetermined initial potential by each of the pixel unit circuits, to compensate for a drift of an actual threshold voltage of the corresponding driving TFT.

Each of the pixel unit circuits includes: a corresponding first TFT, a corresponding second TFT, a corresponding third TFT, a corresponding fourth TFT, a corresponding fifth TFT, a corresponding sixth TFT, a corresponding capacitor, and a corresponding LED.

The first TFT has a gate electrically connected to a first node, a source electrically connected to a second node, and a drain electrically connected to a third node, and the first TFT is the driving TFT.

The second TFT has a gate receiving an (n)th scan signal corresponding to a corresponding row that each of the pixel unit circuits is located, a source electrically connected to the second node, and a drain receiving a data signal.

The third TFT has a gate receiving the (n)th scan signal corresponding to the corresponding row that each of the pixel unit circuits is located, a source electrically connected to the first node, and a drain electrically connected to the third node.

N is an integer greater than one, the fourth TFT has a gate receiving an (n−1)th scan signal corresponding to a previous row of the corresponding row that each of the pixel unit circuits is located, a source receiving the sum of the initial threshold voltage and the predetermined initial potential, and a drain electrically connected to the first node.

The fifth TFT has a gate receiving a control signal, a source receiving a positive supply voltage, and a drain electrically connected to the second node.

The sixth TFT has a gate receiving the control signal, a source electrically connected to the third node, and the drain electrically connected to an anode of the LED.

A cathode of the LED receives a negative supply voltage.

The capacitor has one end electrically connected to the first node, and the other end electrically connected to the positive supply voltage.

The first TFT, the second TFT, the third TFT, the fourth TFT, the fifth TFT, and the sixth TFT are all P-type TFTs.

In the step of S3, the control signal, the (n−1)th scan signal, and the (n)th scan signal are combined such that a plurality of corresponding combined portions correspond to a reset phase, a phase for data to be input and to program, and a display light emitting phase sequentially.

During the reset phase, the control signal is at a high potential, the (n−1)th scan signal is at a low potential, and the (n)th scan signal is at the high potential.

During the phase for data to be input and to program, the control signal is at the high potential, the (n−1)th scan signal is the high potential, and the (n)th scan signal is at the low potential.

During the display light emitting phase, the control signal is at the low potential, the (n−1)th scan signal is at the high potential, and the (n)th scan signal is at the high potential.

Advantages of the present disclosure are as follows. An OLED display panel of the present disclosure includes a plurality of pixel unit circuits and an external compensation unit connected to all of the pixel unit circuits. The external compensation unit performs external compensation on each of the pixel unit circuits, obtains an initial threshold voltage of a corresponding driving TFT of each of the pixel unit circuits, adds the initial threshold voltage to a predetermined initial potential, and then inputs a sum of the initial threshold voltage and the predetermined initial potential to each of the pixel unit circuits. Each of the pixel unit circuits performs internal compensation based on the sum of the initial threshold voltage and the predetermined initial potential. That is, the external compensation and the internal compensation are combined. The external compensation can compensate for a non-uniformity of the corresponding initial threshold voltage of each driving TFT caused by a process, and a permanent drift of a corresponding actual threshold voltage of each driving TFT due to external stress. The internal compensation can instantly compensate for a relatively smaller drift of the actual threshold voltage occurred when the OLED display panel is lightened. An OLED display panel driving method of the present disclosure combines the external compensation and the internal compensation. The external compensation can compensate for the non-uniformity of the corresponding initial threshold voltage of each driving TFT caused by the process, and the permanent drift of the corresponding actual threshold voltage of each driving TFT due to the external stress. The internal compensation can instantly compensate for the relatively smaller drift of the actual threshold voltage occurred when the OLED display panel is lightened.

DESCRIPTION OF DRAWINGS

In order to further understand features and technical content of the present disclosure, please refer to the detail description and the drawings of the present disclosure below. However, the drawings are only used for reference and for illustration, and are not used to limit the present disclosure.

DETAILED DESCRIPTION OF PREFERRED EMBODIMENTS

In order to further describe technical means used by the present disclosure and effects thereof, preferred embodiments of the present disclosure are described in detail below in conjunction with the drawings thereof.

Figure 1:
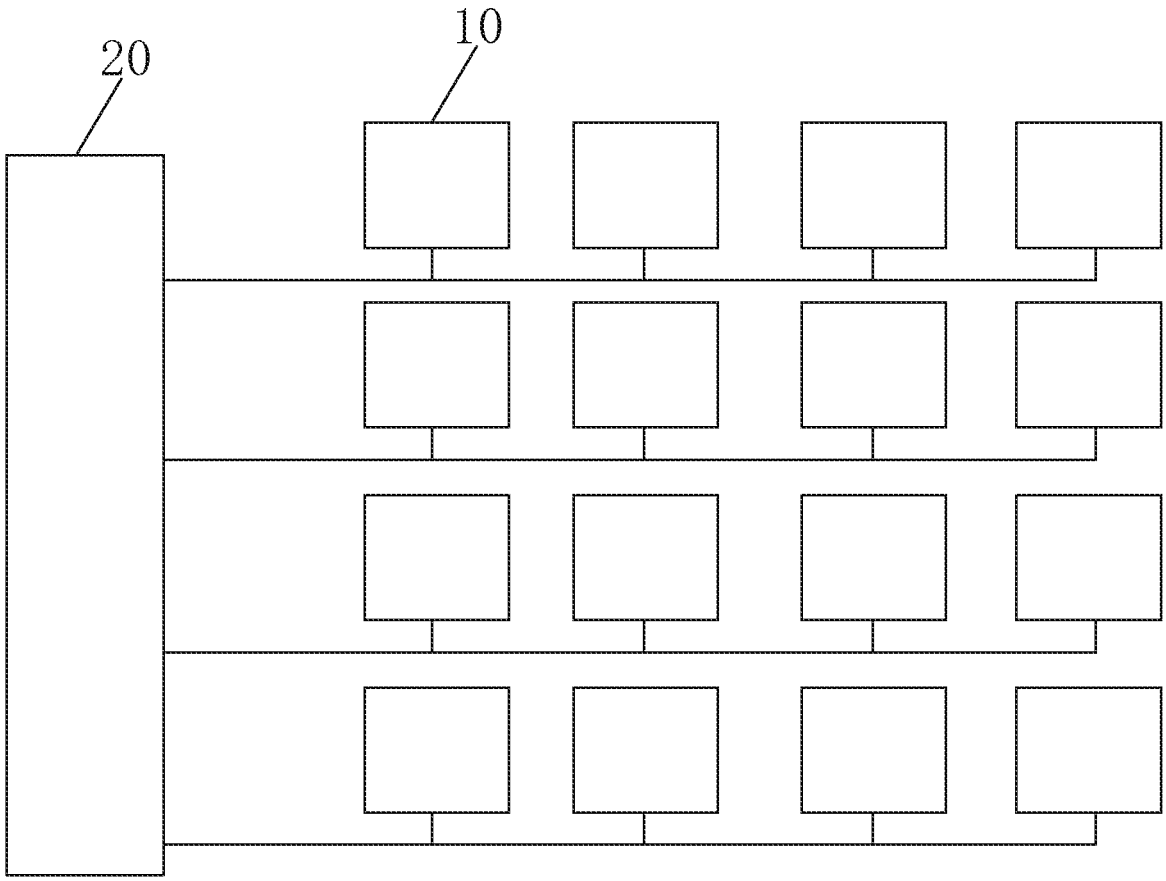
FIG. 1 is a schematic diagram of an OLED display panel of the present disclosure.

Referring to FIG. 1, the present disclosure provides an organic light emitting diode (OLED) display panel including: a plurality of pixel unit circuits 10 and an external compensation unit 20 connected to all of the pixel unit circuits 10.

The external compensation unit 20 is configured to perform external compensation on each of the pixel unit circuits 10, obtain an initial threshold voltage Vth1 of a corresponding driving thin film transistor (TFT) of each of the pixel unit circuits 10, add the initial threshold voltage Vth1 to a predetermined initial potential Vi, and then input a sum of the initial threshold voltage Vth1 and the predetermined initial potential Vi to each of the pixel unit circuits 10.

Each of the pixel unit circuits 10 is configured to perform internal compensation based on the sum of the initial threshold voltage Vth1 and the predetermined initial potential Vi, to compensate for a drift of an actual threshold voltage Vth of the corresponding driving TFT.

Figure 2:
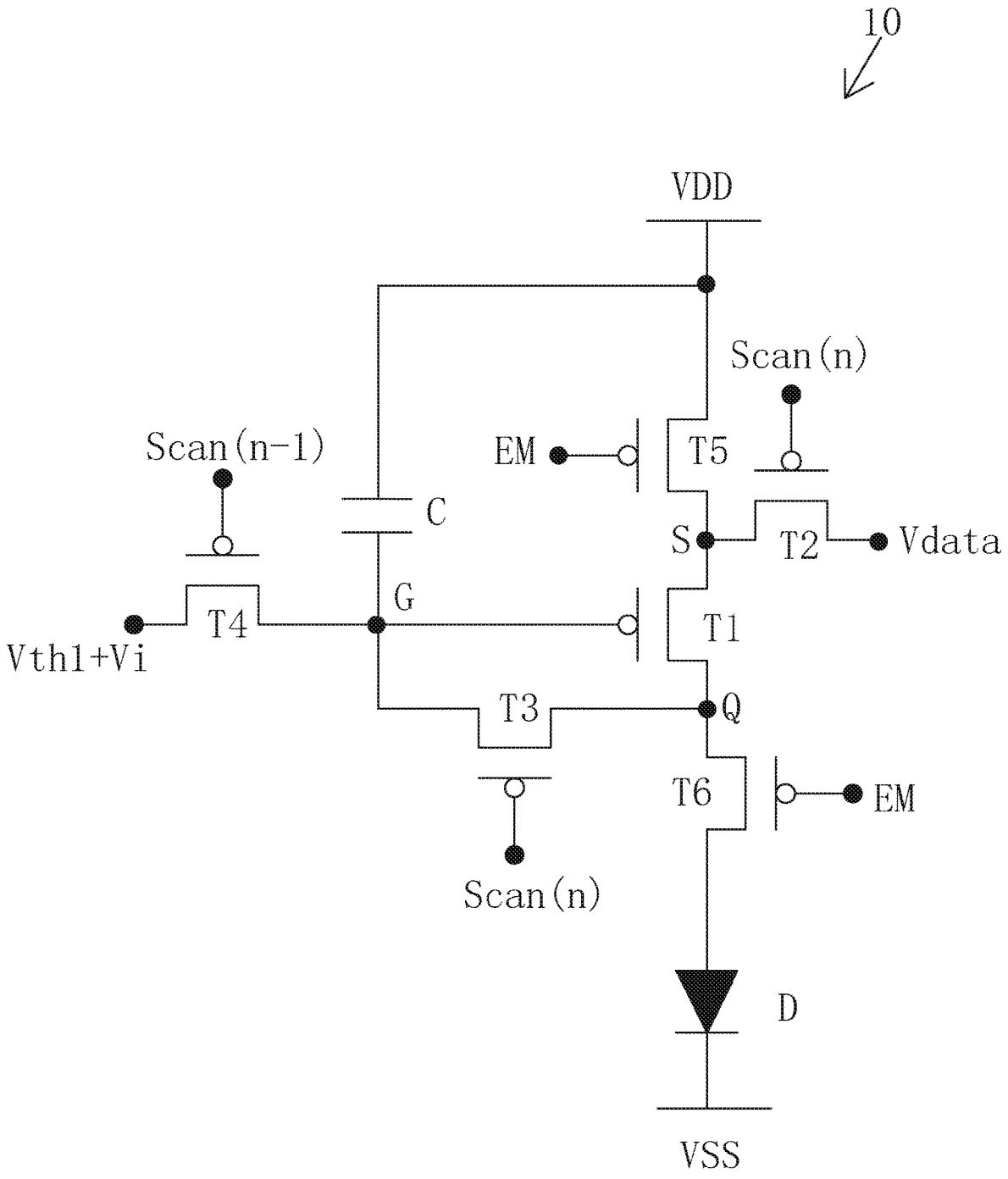
FIG. 2 is a schematic diagram of a pixel unit circuit of the OLED display panel of the present disclosure.

Specifically, referring to FIG. 2, each of the pixel unit circuits 10 includes: a corresponding first TFT T1, a corresponding second TFT T2, a corresponding third TFT T3, a corresponding fourth TFT T4, a corresponding fifth TFT T5, a corresponding sixth TFT T6, a corresponding capacitor C, and a corresponding light emitting diode (LED) D.

The first TFT T1 has a gate electrically connected to a first node G, a source electrically connected to a second node S, and a drain electrically connected to a third node Q, and the first TFT T1 is the driving TFT.

The second TFT T2 has a gate receiving an (n)th scan signal Scan(n) corresponding to a corresponding row that each of the pixel unit circuits 10 is located, a source electrically connected to the second node S, and a drain receiving a data signal Vdata.

The third TFT T3 has a gate receiving the (n)th scan signal Scan(n) corresponding to the corresponding row that each of the pixel unit circuits 10 is located, a source electrically connected to the first node G, and a drain electrically connected to the third node Q.

N is an integer greater than one, the fourth TFT T4 has a gate receiving an (n−1)th scan signal Scan(n−1) corresponding to a previous row of the corresponding row that each of the pixel unit circuits 10 is located, a source receiving the sum of the initial threshold voltage Vth1 and the predetermined initial potential Vi, and a drain electrically connected to the first node G.

The fifth TFT T5 has a gate receiving a control signal EM, a source receiving a positive supply voltage VDD, and a drain electrically connected to the second node S.

The sixth TFT T6 has a gate receiving the control signal EM, a source electrically connected to the third node Q, and the drain electrically connected to an anode of the LED D.

A cathode of the LED D receives a negative supply voltage VSS.

The capacitor C has one end electrically connected to the first node G, and the other end electrically connected to the positive supply voltage VDD.

Specifically, the first TFT T1, the second TFT T2, the third TFT T3, the fourth TFT T4, the fifth TFT T5, and the sixth TFT T6 are all P-type TFTs.

Figure 3:
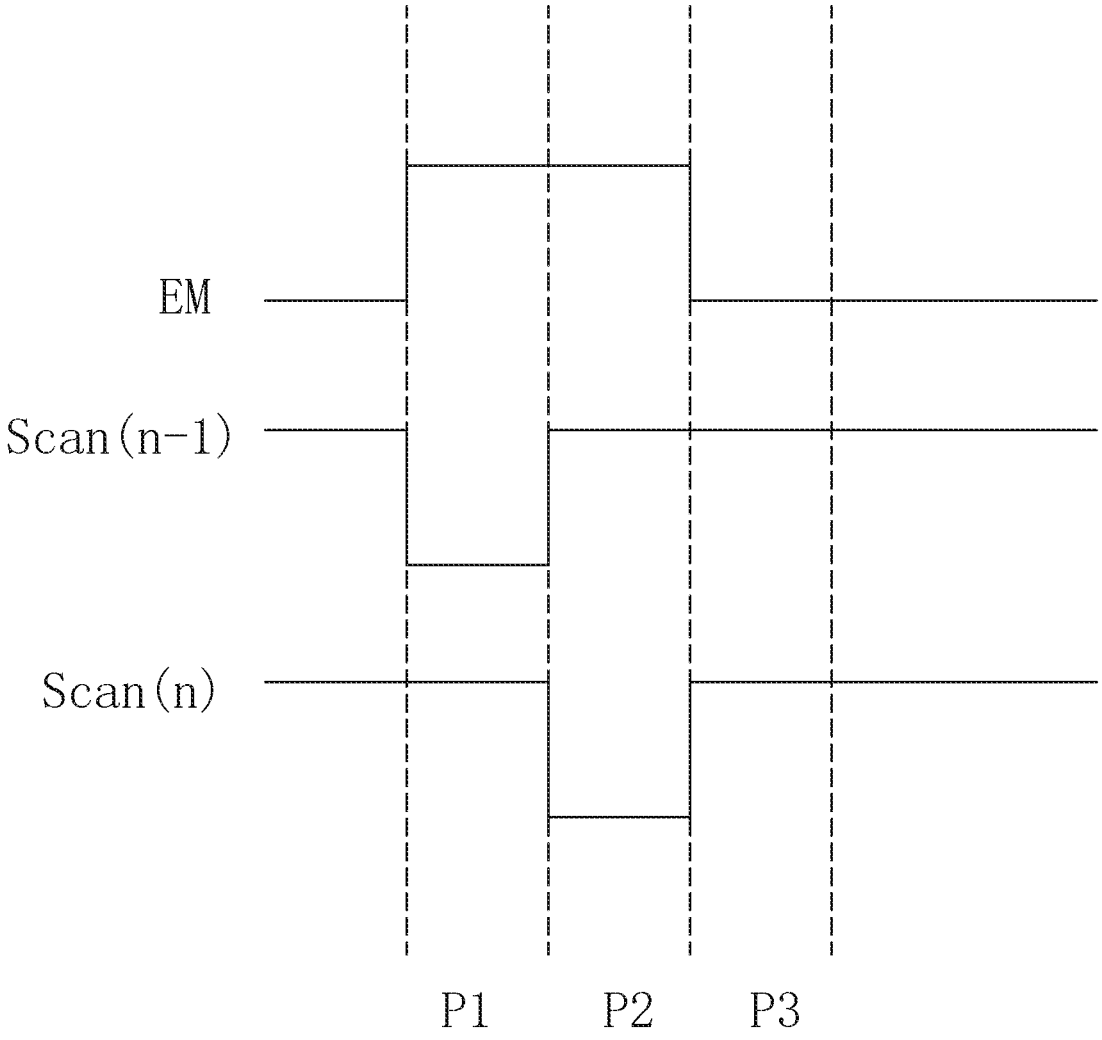
FIG. 3 is a timing diagram of a plurality of signals of the pixel unit circuit of the OLED display panel of the present disclosure.

Specifically, referring to FIG. 3, the control signal EM, the (n−1)th scan signal Scan(n−1), and the (n)th scan signal Scan(n) are combined such that a plurality of corresponding combined portions correspond to a reset phase P1, a phase for data to be input and to program P2, and a display light emitting phase P3 sequentially.

Figure 4:
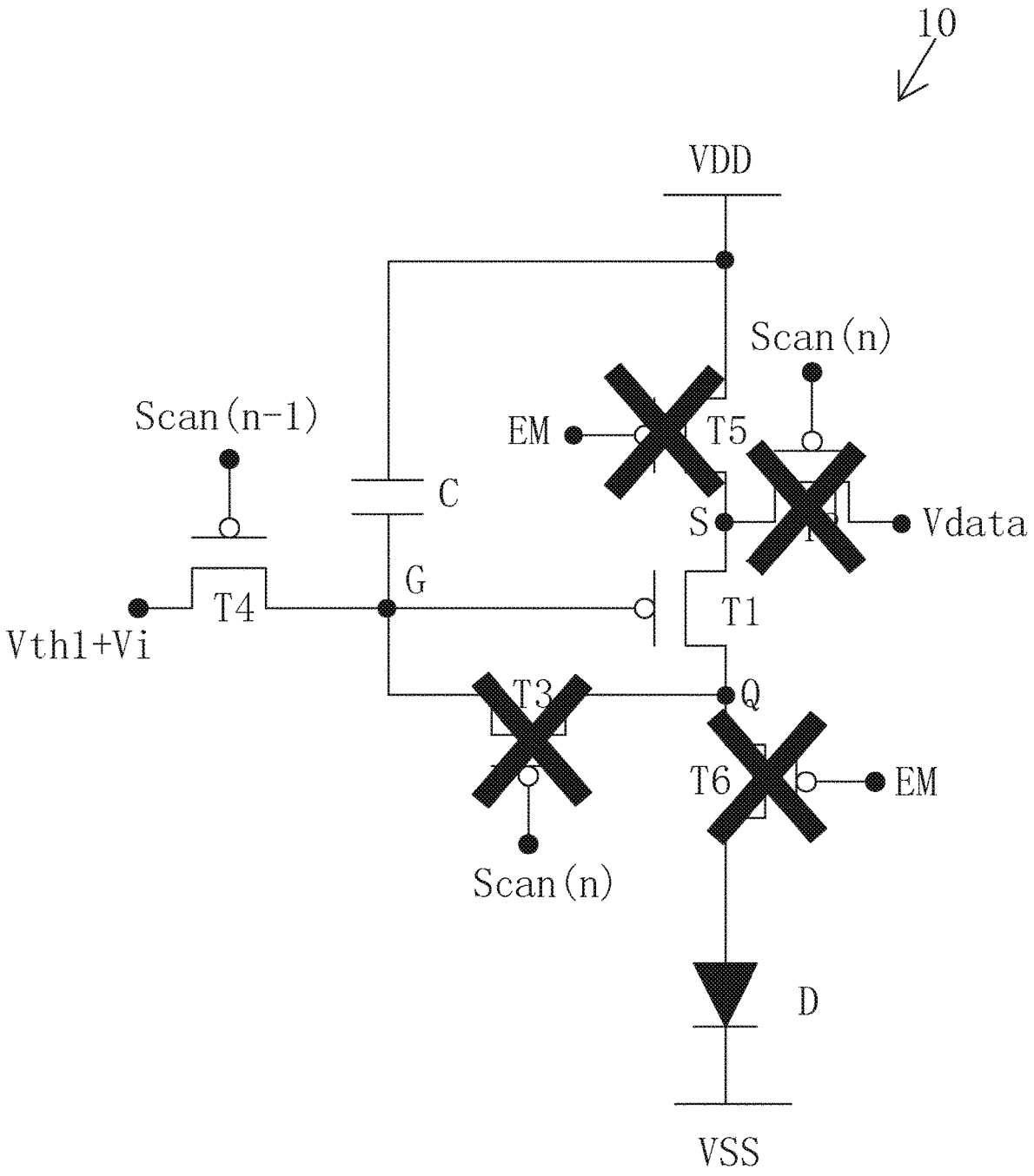
FIG. 4 is a schematic diagram of the pixel unit circuit of the OLED display panel of the present disclosure during a reset phase.

Referring to FIG. 4, during the reset phase P1, the control signal EM is at a high potential, the (n−1)th scan signal Scan(n−1) is at a low potential, and the (n)th scan signal Scan(n) is at the high potential. The second TFT T2, the third TFT T3, the fifth TFT T5, and the sixth TFT T6 are all turned off. The fourth TFT T4 is turned on. A voltage at the gate of the first TFT T1 is reset to the sum of the initial threshold voltage Vth1 and the predetermined initial potential Vi. It can be ensured that when the actual threshold voltage Vth is detected during the phase for data to be input and to program P2 subsequently, a variation trend of the voltage at the gate of the first TFT T1 does not change when the actual threshold voltage Vth of the first TFT T1 varies. This process is for compensating for a non-uniformity of the corresponding initial threshold voltage of each driving TFT caused by a process, and a non-uniformity the corresponding threshold voltage caused by factors such as voltage stress or temperature during a previous lightening process of the OLED display panel.

Figure 5:
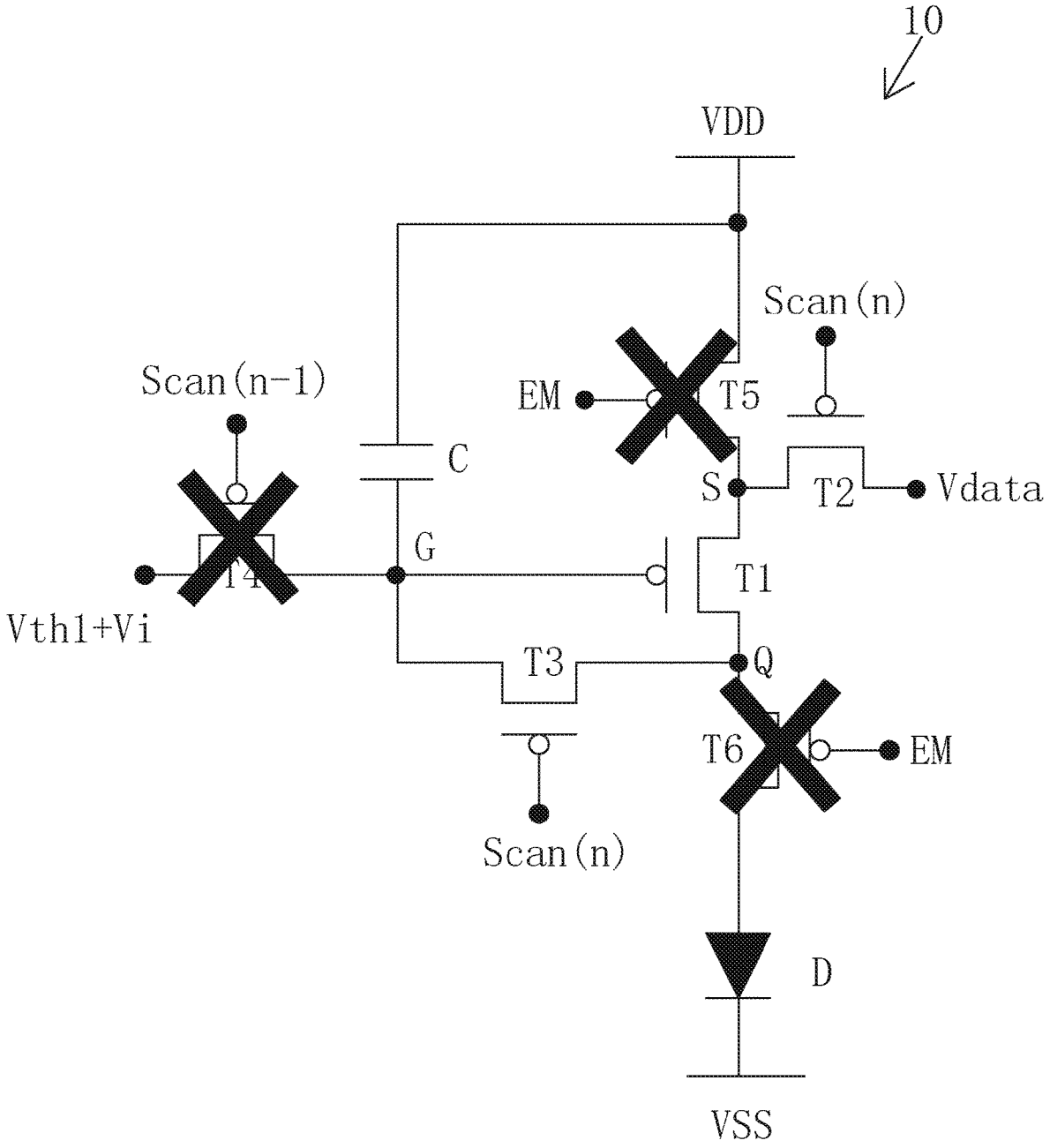
FIG. 5 is a schematic diagram of the pixel unit circuit of the OLED display panel of the present disclosure during a phase for data to be input and to program.

Referring to FIG. 5, during the phase for data to be input and to program P2, the control signal EM is at the high potential, the (n−1)th scan signal Scan(n−1) is the high potential, and the (n)th scan signal Scan(n) is at the low potential. The fourth TFT T4, the fifth TFT T5, and the sixth TFT T6 are all turned off. The second TFT T2 and the third TFT T3 are turned on. The data signal Vdata is input to the source of the first TFT T1. The gate and the drain of the first TFT T1 are connected together, so that a potential at the gate is same as a potential at the drain. At this time, the gate and the drain of the first TFT T1 start to discharge until the voltage at the gate of the first TFT T1 is equal to Vdd+Vth. At this time, the actual threshold voltage Vth of the first TFT T1 and the data signal Vdata are held at the gate of the first TFT T1.

Figure 6:
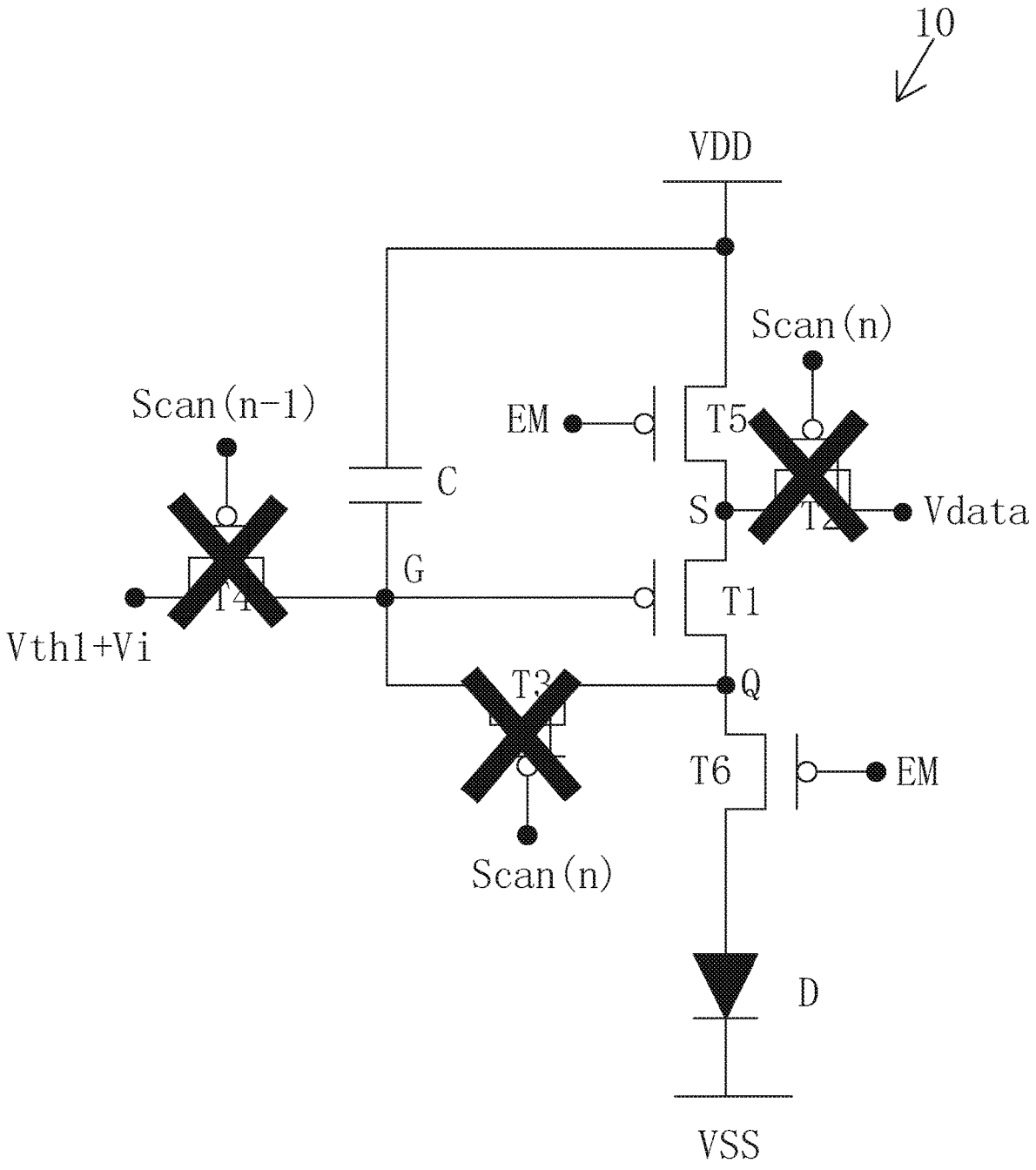
FIG. 6 is a schematic diagram of the pixel unit circuit of the OLED display panel of the present disclosure during a display light emitting phase.

Referring to FIG. 6, during the display light emitting phase P3, the control signal EM is at the low potential, the (n−1)th scan signal Scan(n−1) is at the high potential, and the (n)th scan signal Scan(n) is at the high potential. The second TFT T2, the third TFT T3, and the fourth TFT T4 are all turned off. The fifth TFT T5 and the sixth TFT T6 are turned on. At this time, an equation of a current flowing through the LED D is as follows: $I_{OLED}=K\times(Vgs-Vth)^2=K\times(Vdata+Vth-VDD-Vth)^2=K\times(Vdata-VDD)^2$, where K is an intrinsic conductivity factor of the driving TFT (i.e., the first TFT T1). It can be seen that the current flowing through the LED D is not related to the actual threshold voltage Vth of the first TFT T1 (i.e., the driving TFT), thereby eliminating an effect of the drift of the actual threshold voltage Vth of the driving TFT on the LED D. Therefore, display brightness of the OLED display panel is more uniform, and display quality of the OLED display panel is enhanced.

It is to be noted that the present disclosure uses both the advantage of fast operation speed of an internal compensation circuit and the advantage of a large compensation range of an external compensation circuit. An internal compensation method and an external compensation method of a pixel compensation circuit are combined. Before the OLED display panel is driven to be lightened, the external compensation is first performed by the external compensation unit 20. The initial threshold voltage Vth1 of the corresponding driving TFT of each of the pixel unit circuits 10 is obtained. During a process that the OLED display panel is lightened, the initial threshold voltage Vth1 is added to the predetermined initial potential Vi, and the sum of the initial threshold voltage Vth1 and the predetermined initial potential Vi is input to each of the pixel unit circuits 10 and act together with a process of the internal compensation of each of the pixel unit circuits 10. During an entire process, the external compensation can compensate for a non-uniformity of the corresponding initial threshold voltage Vth1 of each driving TFT caused by a process, and a permanent drift of the corresponding actual threshold voltage Vth of each driving TFT due to external stress. The internal compensation can instantly compensate for a relatively smaller drift of the actual threshold voltage Vth occurred when the OLED display panel is lightened.

For example, when the corresponding initial threshold voltage Vth1 of each of the driving TFTs in the OLED display panel differs by ±1V due to process reasons, if only internal compensation is performed, a current flowing through the corresponding LED D of each of the pixel unit circuits 10 may differ by a percentage as high as around 15%. At this time, the OLED display panel exhibits a significant non-uniformity. The present disclosure may control the current $I_{OLED}$ flowing through the corresponding LED D of each of the pixel unit circuits 10 to differ by at most 2%. At this time, uniformity performance of the panel is greatly enhanced.

When the OLED display panel performs external compensation without internal compensation, the actual threshold voltage Vth of each of the driving TFTs drifts by ±0.5V due to temperature or voltage stress. Then, a current $I_{OLED}$ flowing through the corresponding LED D of each of the pixel unit circuits 10 may differ by a percentage as high as around 25%. The present disclosure may control the current $I_{OLED}$ flowing through the corresponding LED D of each of the pixel unit circuits 10 to differ by at most 5%. At this time, uniformity performance of the panel is greatly enhanced.

Figure 7:
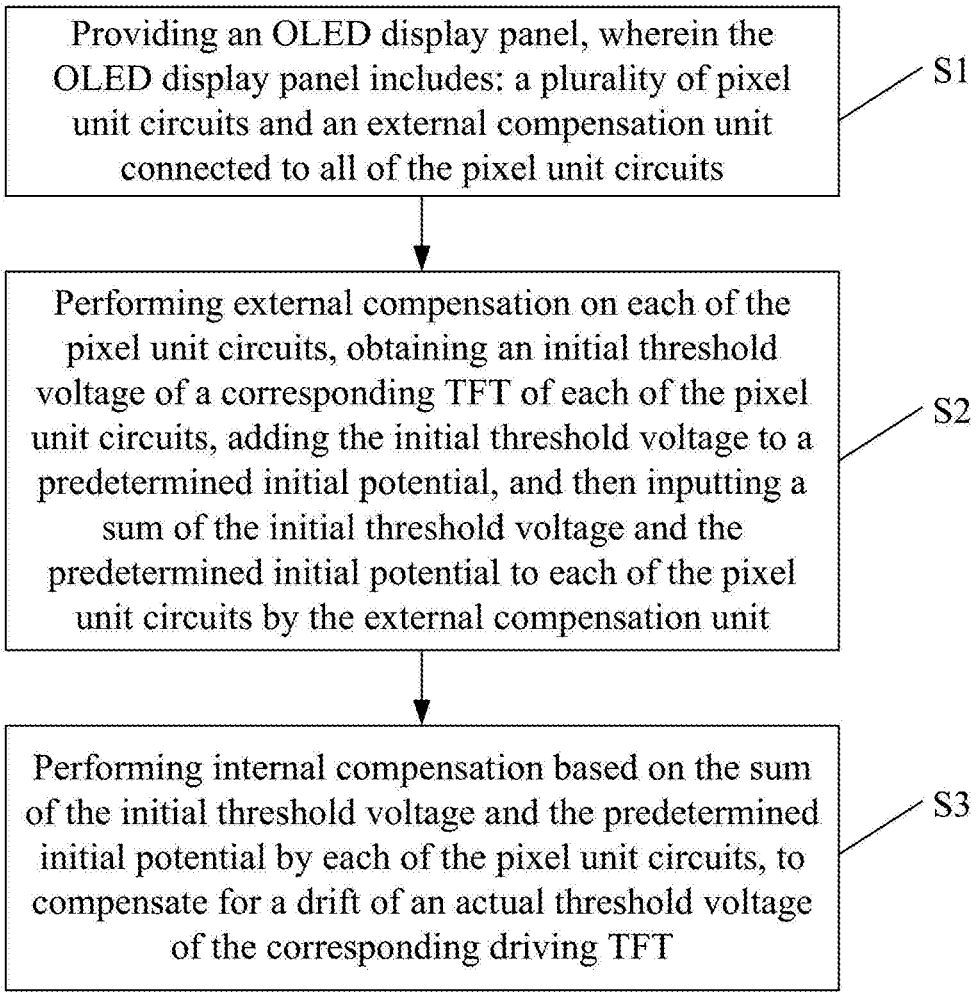
FIG. 7 is a flowchart of an OLED display panel driving method of the present disclosure.

Referring to FIG. 7, based on the aforementioned OLED display panel, the present disclosure also provides an OLED display panel driving method including the following steps.

In a step S1, referring to FIG. 1, an OLED display panel is provided. The OLED display panel includes: a plurality of pixel unit circuits 10 and an external compensation unit 20 connected to all of the pixel unit circuits 10.

In a step S2, external compensation are performed on each of the pixel unit circuits 10, an initial threshold voltage Vth1 of a corresponding driving TFT of each of the pixel unit circuits 10 is obtained, the initial threshold voltage Vth1 is added to a predetermined initial potential Vi, and a sum of the initial threshold voltage Vth1 and the predetermined initial potential Vi is input to each of the pixel unit circuits 10 by the external compensation unit 20.

In a step S3, internal compensation is performed based on the sum of the initial threshold voltage Vth1 and the predetermined initial potential Vi by each of the pixel unit circuits 10, to compensate for a drift of an actual threshold voltage Vth of the corresponding driving TFT.

Specifically, referring to FIG. 2, each of the pixel unit circuits 10 includes: a corresponding first TFT T1, a corresponding second TFT T2, a corresponding third TFT T3, a corresponding fourth TFT T4, a corresponding fifth TFT T5, a corresponding sixth TFT T6, a corresponding capacitor C, and a corresponding LED D.

The first TFT T1 has a gate electrically connected to a first node G, a source electrically connected to a second node S, and a drain electrically connected to a third node Q, and the first TFT T1 is the driving TFT.

The second TFT T2 has a gate receiving an (n)th scan signal Scan(n) corresponding to a corresponding row that each of the pixel unit circuits 10 is located, a source electrically connected to the second node S, and a drain receiving a data signal Vdata.

The third TFT T3 has a gate receiving the (n)th scan signal Scan(n) corresponding to the corresponding row that each of the pixel unit circuits 10 is located, a source electrically connected to the first node G, and a drain electrically connected to the third node Q.

N is an integer greater than one, the fourth TFT T4 has a gate receiving an (n−1)th scan signal Scan(n−1) corresponding to a previous row of the corresponding row that each of the pixel unit circuits 10 is located, a source receiving the sum of the initial threshold voltage Vth1 and the predetermined initial potential Vi, and a drain electrically connected to the first node G.

The fifth TFT T5 has a gate receiving a control signal EM, a source receiving a positive supply voltage VDD, and a drain electrically connected to the second node S.

The sixth TFT T6 has a gate receiving the control signal EM, a source electrically connected to the third node Q, and the drain electrically connected to an anode of the LED D.

A cathode of the LED D receives a negative supply voltage VSS.

The capacitor C has one end electrically connected to the first node G, and the other end electrically connected to the positive supply voltage VDD.

Specifically, the first TFT T1, the second TFT T2, the third TFT T3, the fourth TFT T4, the fifth TFT T5, and the sixth TFT T6 are all P-type TFTs.

Specifically, referring to FIG. 3, in the step of S3, the control signal EM, the (n−1)th scan signal Scan(n−1), and the (n)th scan signal Scan(n) are combined such that a plurality of corresponding combined portions correspond to a reset phase P1, a phase for data to be input and to program P2, and a display light emitting phase P3 sequentially.

Referring to FIG. 4, during the reset phase P1, the control signal EM is at a high potential, the (n−1)th scan signal Scan(n−1) is at a low potential, and the (n)th scan signal Scan(n) is at the high potential. The second TFT T2, the third TFT T3, the fifth TFT T5, and the sixth TFT T6 are all turned off. The fourth TFT T4 is turned on. A voltage at the gate of the first TFT T1 is reset to the sum of the initial threshold voltage Vth1 and the predetermined initial potential Vi. It can be ensured that when the actual threshold voltage Vth is detected during the phase for data to be input and to program P2 subsequently, a variation trend of the voltage at the gate of the first TFT T1 does not change when the actual threshold voltage Vth of the first TFT T1 varies. This process is for compensating for a non-uniformity of the corresponding initial threshold voltage of each driving TFT caused by a process, and a non-uniformity the corresponding threshold voltage caused by factors such as voltage stress or temperature during a previous lightening process of the OLED display panel.

Referring to FIG. 5, during the phase for data to be input and to program P2, the control signal EM is at the high potential, the (n−1)th scan signal Scan(n−1) is the high potential, and the (n)th scan signal Scan(n) is at the low potential. The fourth TFT T4, the fifth TFT T5, and the sixth TFT T6 are all turned off. The second TFT T2 and the third TFT T3 are turned on. The data signal Vdata is input to the source of the first TFT T1. The gate and the drain of the first TFT T1 are connected together, so that a potential at the gate is same as a potential at the drain. At this time, the gate and the drain of the first TFT T1 start to discharge until the voltage at the gate of the first TFT T1 is equal to Vdd+Vth. At this time, the actual threshold voltage Vth of the first TFT T1 and the data signal Vdata are held at the gate of the first TFT T1.

Referring to FIG. 6, during the display light emitting phase P3, the control signal EM is at the low potential, the (n−1)th scan signal Scan(n−1) is at the high potential, and the (n)th scan signal Scan(n) is at the high potential. The second TFT T2, the third TFT T3, and the fourth TFT T4 are all turned off. The fifth TFT T5 and the sixth TFT T6 are turned on. At this time, an equation of a current flowing through the LED D is as follows: $I_{OLED}=K\times(Vgs-Vth)^2=K\times(Vdata+Vth-VDD-Vth)^2=K\times(Vdata-VDD)^2$, where K is an intrinsic conductivity factor of the driving TFT (i.e., the first TFT T1). It can be seen that the current flowing through the LED D is not related to the actual threshold voltage Vth of the first TFT T1 (i.e., the driving TFT), thereby eliminating an effect of the drift of the actual threshold voltage Vth of the driving TFT on the LED D. Therefore, display brightness of the OLED display panel is more uniform, and display quality of the OLED display panel is enhanced.

It is to be noted that the present disclosure uses both the advantage of fast operation speed of an internal compensation circuit and the advantage of a large compensation range of an external compensation circuit. An internal compensation method and an external compensation method of a pixel compensation circuit are combined. Before the OLED display panel is driven to be lightened, the external compensation is first performed by the external compensation unit 20. The initial threshold voltage Vth1 of the corresponding driving TFT of each of the pixel unit circuits 10 is obtained. During a process that the OLED display panel is lightened, the initial threshold voltage Vth1 is added to the predetermined initial potential Vi, and the sum of the initial threshold voltage Vth1 and the predetermined initial potential Vi is input to each of the pixel unit circuits 10 and act together with a process of the internal compensation of each of the pixel unit circuits 10. During an entire process, the external compensation can compensate for a non-uniformity of the corresponding initial threshold voltage Vth1 of each driving TFT caused by a process, and a permanent drift of the corresponding actual threshold voltage Vth of each driving TFT due to external stress. The internal compensation can instantly compensate for a relatively smaller drift of the actual threshold voltage Vth occurred when the OLED display panel is lightened.

For example, when the corresponding initial threshold voltage Vth1 of each of the driving TFTs in the OLED display panel differs by ±1V due to process reasons, if only internal compensation is performed, a current flowing through the corresponding LED D of each of the pixel unit circuits 10 may differ by a percentage as high as around 15%. At this time, the OLED display panel exhibits a significant non-uniformity. The present disclosure may control the current $I_{OLED}$ flowing through the corresponding LED D of each of the pixel unit circuits 10 to differ by at most 2%. At this time, uniformity performance of the panel is greatly enhanced.

When the OLED display panel performs external compensation without internal compensation, the actual threshold voltage Vth of each of the driving TFTs drifts by ±0.5V due to temperature or voltage stress. Then, a current $I_{OLED}$ flowing through the corresponding LED D of each of the pixel unit circuits 10 may differ by a percentage as high as around 25%. The present disclosure may control the current $I_{OLED}$ flowing through the corresponding LED D of each of the pixel unit circuits 10 to differ by at most 5%. At this time, uniformity performance of the panel is greatly enhanced.

In summary, an OLED display panel of the present disclosure includes a plurality of pixel unit circuits and an external compensation unit connected to all of the pixel unit circuits. The external compensation unit performs external compensation on each of the pixel unit circuits, obtains an initial threshold voltage of a corresponding driving TFT of each of the pixel unit circuits, adds the initial threshold voltage to a predetermined initial potential, and then inputs a sum of the initial threshold voltage and the predetermined initial potential to each of the pixel unit circuits. Each of the pixel unit circuits performs internal compensation based on the sum of the initial threshold voltage and the predetermined initial potential. That is, the external compensation and the internal compensation are combined. The external compensation can compensate for a non-uniformity of the corresponding initial threshold voltage of each driving TFT caused by a process, and a permanent drift of a corresponding actual threshold voltage of each driving TFT due to external stress. The internal compensation can instantly compensate for a relatively smaller drift of the actual threshold voltage occurred when the OLED display panel is lightened. An OLED display panel driving method of the present disclosure combines the external compensation and the internal compensation. The external compensation can compensate for the non-uniformity of the corresponding initial threshold voltage of each driving TFT caused by the process, and the permanent drift of the corresponding actual threshold voltage of each driving TFT due to external stress. The internal compensation can instantly compensate for the relatively smaller drift of the actual threshold voltage occurred when the OLED display panel is lightened.

To persons skilled in the art, in accordance with the technical solutions and technical ideas of the present disclosure, various changes and modifications may be made to the description above. All these changes and modifications are within the protection scope of the claims of the present disclosure.

What is claimed is:

1. An organic light emitting diode (OLED) display panel, comprising:

a plurality of pixel unit circuits;

wherein external compensation is performed on each of the pixel unit circuits, an initial threshold voltage of a corresponding driving thin film transistor (TFT) of each of the pixel unit circuits is obtained, the initial threshold voltage is added to a predetermined initial potential, and then a sum of the initial threshold voltage and the predetermined initial potential is inputted to each of the pixel unit circuits;

wherein each of the pixel unit circuits is configured to perform internal compensation based on the sum of the initial threshold voltage and the predetermined initial potential, to compensate for a drift of an actual threshold voltage of the corresponding driving TFT; and wherein each of the pixel unit circuits comprises: a corresponding first TFT, a corresponding second TFT, a corresponding third TFT, a corresponding fourth TFT, a corresponding fifth TFT, a corresponding sixth TFT, a corresponding capacitor, and a corresponding light emitting diode (LED);

wherein the first TFT has a gate electrically connected to a first node, a source electrically connected to a second node, and a drain electrically connected to a third node, and the first TFT is the driving TFT;

wherein the second TFT has a gate receiving an (n)th scan signal corresponding to a corresponding row that each of the pixel unit circuits is located, a source electrically connected to the second node, and a drain receiving a data signal;

wherein the third TFT has a gate receiving the (n)th scan signal corresponding to the corresponding row that each of the pixel unit circuits is located, a source electrically connected to the first node, and a drain electrically connected to the third node;

wherein n is an integer greater than one, the fourth TFT has a gate receiving an (n−1)th scan signal corresponding to a previous row of the corresponding row that each of the pixel unit circuits is located, a source receiving the sum of the initial threshold voltage and the predetermined initial potential, and a drain electrically connected to the first node;

wherein the fifth TFT has a gate receiving a control signal, a source receiving a positive supply voltage, and a drain electrically connected to the second node;

wherein the sixth TFT has a gate receiving the control signal, a source electrically connected to the third node, and a drain electrically connected to an anode of the LED;

wherein a cathode of the LED receives a negative supply voltage; and wherein the capacitor has one end electrically connected to the first node, and the other end electrically connected to the positive supply voltage.

2. The OLED display panel of claim 1, wherein the first TFT, the second TFT, the third TFT, the fourth TFT, the fifth TFT, and the sixth TFT are all P-type TFTs.

3. The OLED display panel of claim 2, wherein the control signal, the (n−1)th scan signal, and the (n)th scan signal are combined such that a plurality of corresponding combined portions correspond to a reset phase, a phase for data to be input and to program, and a display light emitting phase sequentially.

4. The OLED display panel of claim 3, wherein during the reset phase, the control signal is at a high potential, the (n−1)th scan signal is at a low potential, and the (n)th scan signal is at the high potential;

wherein during the phase for data to be input and to program, the control signal is at the high potential, the (n−1)th scan signal is the high potential, and the (n)th scan signal is at the low potential; and wherein during the display light emitting phase, the control signal is at the low potential, the (n−1)th scan signal is at the high potential, and the (n)th scan signal is at the high potential.

5. An organic light emitting diode (OLED) display panel driving method, comprising:

a step S1 of providing an OLED display panel, wherein the OLED display panel comprises:

a plurality of pixel unit circuits and an external compensation unit connected to all of the pixel unit circuits;

a step S2 of performing external compensation on each of the pixel unit circuits, obtaining an initial threshold voltage of a corresponding driving thin film transistor (TFT) of each of the pixel unit circuits, adding the initial threshold voltage to a predetermined initial potential, and then inputting a sum of the initial threshold voltage and the predetermined initial potential to each of the pixel unit circuits by the external compensation unit; and a step S3 of performing internal compensation based on the sum of the initial threshold voltage and the predetermined initial potential by each of the pixel unit circuits, to compensate for a drift of an actual threshold voltage of the corresponding driving TFT;

wherein each of the pixel unit circuits comprises: a corresponding first TFT, a corresponding second TFT, a corresponding third TFT, a corresponding fourth TFT, a corresponding fifth TFT, a corresponding sixth TFT, a corresponding capacitor, and a corresponding light emitting diode (LED);

wherein the first TFT has a gate electrically connected to a first node, a source electrically connected to a second node, and a drain electrically connected to a third node, and the first TFT is the driving TFT;

wherein the second TFT has a gate receiving an (n)th scan signal corresponding to a corresponding row that each of the pixel unit circuits is located, a source electrically connected to the second node, and a drain receiving a data signal;

wherein the third TFT has a gate receiving the (n)th scan signal corresponding to the corresponding row that each of the pixel unit circuits is located, a source electrically connected to the first node, and a drain electrically connected to the third node;

wherein n is an integer greater than one, the fourth TFT has a gate receiving an (n−1)th scan signal corresponding to a previous row of the corresponding row that each of the pixel unit circuits is located, a source receiving the sum of the initial threshold voltage and the predetermined initial potential, and a drain electrically connected to the first node;

wherein the fifth TFT has a gate receiving a control signal, a source receiving a positive supply voltage, and a drain electrically connected to the second node;

wherein the sixth TFT has a gate receiving the control signal, a source electrically connected to the third node, and a drain electrically connected to an anode of the LED;

wherein a cathode of the LED receives a negative supply voltage; and wherein the capacitor has one end electrically connected to the first node, and the other end electrically connected to the positive supply voltage.

6. The OLED display panel driving method of claim 5, wherein the first TFT, the second TFT, the third TFT, the fourth TFT, the fifth TFT, and the sixth TFT are all P-type TFTs.

7. The OLED display panel driving method of claim 6, wherein in the step of S3, the control signal, the (n−1)th scan signal, and the (n)th scan signal are combined such that a plurality of corresponding combined portions correspond to a reset phase, a phase for data to be input and to program, and a display light emitting phase sequentially.

8. The OLED display panel driving method of claim 7, wherein during the reset phase, the control signal is at a high potential, the (n−1)th scan signal is at a low potential, and the (n)th scan signal is at the high potential;

wherein during the phase for data to be input and to program, the control signal is at the high potential, the (n−1)th scan signal is the high potential, and the (n)th scan signal is at the low potential; and wherein during the display light emitting phase, the control signal is at the low potential, the (n−1)th scan signal is at the high potential, and the (n)th scan signal is at the high potential.

* * * * *